US005243257A

United States Patent [19]

Dietrich et al.

[11] Patent Number: 5,243,257

[45] Date of Patent: Sep. 7, 1993

[54] SURGE VOLTAGE PROTECTOR

[75] Inventors: Volker Dietrich; Tha Do-Thoi, both of Röthenbach; Peter Stingl, Lauf-Kuhnhof, all of Fed. Rep. of Germany

[73] Assignee: Hoechst Ceramtec Aktiengesellschaft, Selb, Fed. Rep. of Germany

[21] Appl. No.: 781,584

[22] Filed: Oct. 23, 1991

[30] Foreign Application Priority Data

Oct. 25, 1990 [DE] Fed. Rep. of Germany ..... 4033927

[51] Int. Cl.[5] ..... H01T 2/02; H01T 1/22

[52] U.S. Cl. ..... 313/603; 313/574; 313/596; 313/634; 361/120; 337/28

[58] Field of Search ..... 313/643, 634, 601, 603, 313/574, 325, 596, 621; 428/432, 433; 337/28; 361/120, 119, 118, 117

[56] References Cited

U.S. PATENT DOCUMENTS 4,491,893 1/1985 Toda ..... 361/120
4,628,399 12/1986 Shigemori et al. ..... 313/602 X
4,996,111 2/1991 Do-Thoi et al. ..... 428/432
5,142,194 8/1992 Jacubeit et al. ..... 313/603
5,156,322 10/1992 Do-Thoi et al. ..... 228/124

FOREIGN PATENT DOCUMENTS 0087820 9/1983 European Pat. Off. .
3824900 1/1990 Fed. Rep. of Germany .
82/01792 5/1982 World Int. Prop. O. .

*Primary Examiner*—Donald J. Yusko
*Assistant Examiner*—Ashok Patel
*Attorney, Agent, or Firm*—Foley & Lardner

[57] ABSTRACT

A surge voltage protector having a tubular ceramic part as an insulator, and having metal electrodes soldered onto the end faces thereof. Each electrode is electrically connected in each case to an ignition aid applied at least to the inside wall of the ceramic part. The inside edges of the surfaces joining the ceramic part to the electrodes are each provided with a chamfer whose chamfer angle is 15° to 60° relative to the plane of the joining surfaces. The width projected onto the plane of the joining surface is 0.05 to 0.4 mm.

6 Claims, 1 Drawing Sheet

Fig. 1
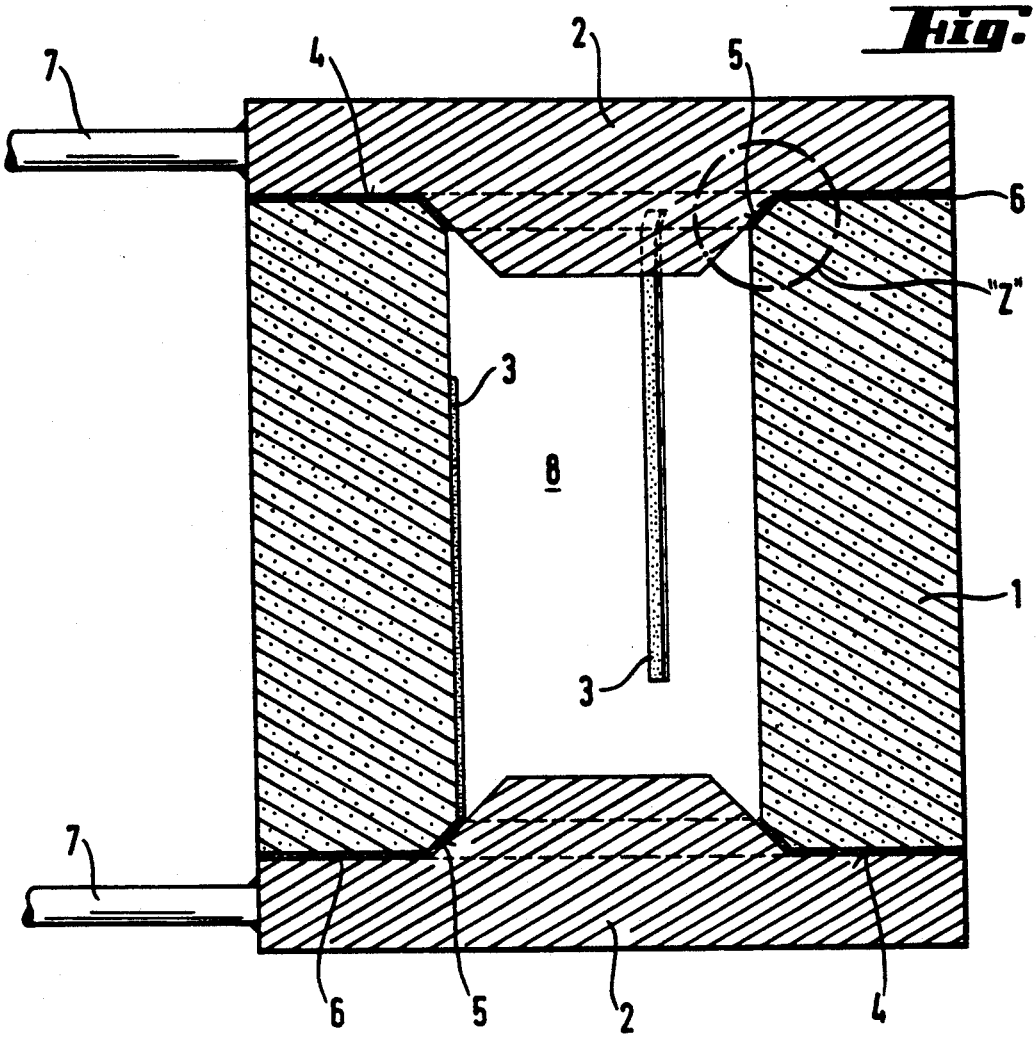
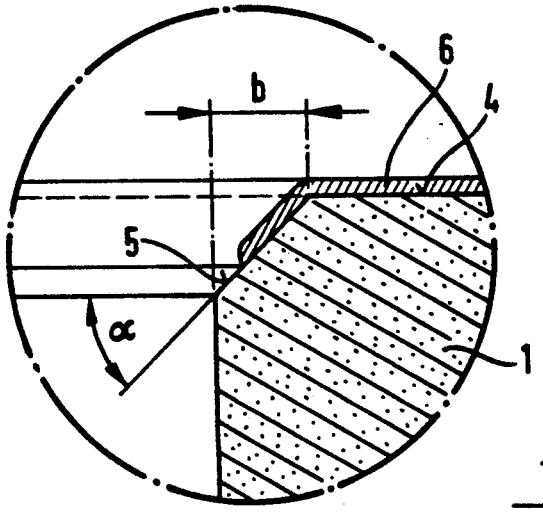
Fig. 2

SURGE VOLTAGE PROTECTOR

FIELD OF THE INVENTION

The invention relates to a surge voltage protector which comprises a tubular ceramic part as an insulator having metal electrodes soldered onto the end faces, each metal electrode being electrically connected in each case to an ignition aid applied at least to the inside wall of the ceramic part.

DESCRIPTION OF RELATED ART

Surge voltage protectors of the type mentioned are known. A disadvantage of these surge voltage protectors is that the preplacement of solder on the end surfaces of the tubular ceramic part, which preplacement is necessary for a solder joint to the metal electrodes, results in a solder overhang which extends into the interior space of the ceramic part at the inside edge of the joining surface. When the ignition aid, in general made of graphite, is applied to the inside wall of the ceramic part, the application device is damaged by the solder overhang, with the result that in many cases no electrical connection is produced between the ignition aid and the solder preplacement. In addition, the application device has to be realigned, and this is troublesome for an automated ignition aid application cycle.

SUMMARY OF THE INVENTION

The object of the invention is to provide a remedy in this connection. This object is achieved by a particular design of the surfaces joining the ceramic part to the metal electrodes, wherein the inside edges of the surfaces joining the ceramic part to the electrodes are each provided with a chamfer whose chamfer angle ($\alpha$) is 15° to 60° and whose width (b) projected onto the plane of the joining surface is 0.05 to 0.4 mm.

Preferably, the chamfer angle $\alpha$ is 45° and the projected width b of the chamfer is 0.1 mm.

The design of the joining surfaces of the ceramic part avoids a solder overhang in the solder preplacement, which is carried out, for example, by the process disclosed by DE-A 3 824 900, with all its disadvantages for the application of the ignition aid with automated devices.

The invention is explained in greater detail below with reference to the drawings, which represent only one method of embodiment. In the drawings:

BRIEF DESCRIPTION OF THE DRAWINGS

FIG. 1 shows the basic construction of a surge voltage protector in section, and FIG. 2 shows the detail "Z" of FIG. 1 without electrode and with solder preplacement.

DETAILED DESCRIPTION

The surge voltage protector comprises a tubular ceramic part 1 composed, for example, of $Al_2O_3$ as insulator. Soldered onto the annular end surfaces of the ceramic part 1 are metal electrodes 2. Said metal electrodes are electrically connected in each case to an ignition aid 3 which is applied to the inside wall of the ceramic part. The inside edges of the joining surfaces 4 of the ceramic part 1 are provided with chamfers 5. The angle $\alpha$ of the chamfer relative to the joining surface may be 15° to 60°, preferably 45°, and the width b of the chamfers 5 projected onto the plane of the joining surface 4 may be 0.05 to 0.4 mm, preferably 0.1 mm. The joining surfaces 4 of the ceramic part 1, and also in part on the chamfers 5, are metallized as usual by solder preplacement (solder layer 6) in order to ensure a gas-tight and firmly adhering solder joint between electrodes and ceramic. The inside space 8 of the surge voltage protector may be filled with a gas, for example a noble gas. 7 indicates the electrical terminals for the electrodes 2. The chamfers 5 on the inside edges of the ceramic part 1 avoid a solder overhang. The metallization 6 ends at the chamfers without reaching the edge of the inside wall of the ceramic part. In addition, the metallization/ceramic transition is almost continuous, with the result that a serviceable ignition aid 3 with electrical connection to the metallization can be applied to the inside wall of the ceramic part.

We claim:

1. A surge voltage protector comprising a tubular ceramic part as an insulator having end faces, and inside walls, and having metal electrodes soldered onto the end faces, each metal electrode being electrically connected to an ignition aid applied at least to the inside wall of the ceramic part, wherein inside edges of surfaces joining the ceramic part to the metal electrodes are each provided with a chamfer whose chamfer angle ($\alpha$) is 15° to 60° relative to the plane of said surfaces joining the ceramic part to the electrodes and whose width (b) projected onto said plane of the surfaces joining the ceramic part to the electrodes is 0.05 to 0.4 mm.

2. The surge voltage protector as claimed in claim 1, wherein the chamfer angle ($\alpha$) is 45° and the projected width (b) is 0.1 mm.

3. The surge voltage protector as claimed in claim 1, wherein said inside walls of the ceramic part form an inside space.

4. The surge voltage protector as claimed in claim 3, wherein said inside space is filled with a noble gas.

5. The surge voltage protector as claimed in claim 1, wherein the surfaces joining the ceramic part to the electrodes are metallized by solder preplacement.

6. The surge voltage protector as claimed in claim 5, wherein said chamfers avoid a solder overhang.

* * * * *